US009397435B2

(12) United States Patent
Xing et al.

(10) Patent No.: US 9,397,435 B2
(45) Date of Patent: Jul. 19, 2016

(54) CONNECTOR ASSEMBLY WITH FIRM STRUCTURE AND METHOD OF ASSEMBLING THE SAME

(71) Applicant: FOXCONN INTERCONNECT TECHNOLOGY LIMITED, Grand Cayman (KY)

(72) Inventors: Da-Wei Xing, Kunshan (CN); Jun Chen, Kunshan (CN); Jerry Wu, Irvine, CA (US); Jia-Chao Yan, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/734,236

(22) Filed: Jun. 9, 2015

(65) Prior Publication Data

US 2015/0357770 A1 Dec. 10, 2015

(30) Foreign Application Priority Data

Jun. 9, 2014 (CN) ..... 2014 1 0249297

(51) Int. Cl.

| | |
|---|---|
| ***H01R 24/00*** | (2011.01) |
| ***H01R 13/504*** | (2006.01) |
| *H01R 107/00* | (2006.01) |
| *H01R 13/6593* | (2011.01) |

(52) U.S. Cl.

CPC ..... *H01R 13/504* (2013.01); *H01R 13/6593* (2013.01); *H01R 2107/00* (2013.01); *Y10T 29/49215* (2015.01)

(58) Field of Classification Search

CPC ..... H01R 13/6658; H01R 23/025; H01R 23/005; H05K 1/0228; H05K 2201/10189

USPC ..... 439/676, 607.58, 76.1

See application file for complete search history.

(56) References Cited

U.S. PATENT DOCUMENTS

| | | | | |
|---|---|---|---|---|
| 3,789,344 | A * | 1/1974 | Brorein | H01R 13/50 439/344 |
| 7,306,479 | B1 * | 12/2007 | Wu | H01R 9/034 439/497 |
| 7,371,118 | B2 * | 5/2008 | Wu | H01R 24/62 439/607.45 |
| 7,618,293 | B2 * | 11/2009 | Wu | H01R 24/62 439/493 |
| 7,625,236 | B1 * | 12/2009 | Wu | H01R 24/62 439/607.58 |
| 7,666,007 | B2 * | 2/2010 | Hsu | H01R 13/6658 235/492 |
| 7,758,373 | B2 * | 7/2010 | Zhou | H01R 13/562 439/455 |
| 7,798,853 | B2 * | 9/2010 | Shi | H01R 13/6658 439/607.58 |
| 7,841,892 | B2 * | 11/2010 | Zhou | H01R 13/5845 439/455 |

(Continued)

*Primary Examiner* — Abdullah Riyami
*Assistant Examiner* — Vladimir Imas
(74) *Attorney, Agent, or Firm* — Ming Chieh Chang; Wei Te Chung

(57) ABSTRACT

A connector assembly includes a housing, a metal shell, plural terminals, a cable, an inner member, and an outer boot. The inner member comprises a dispensing groove and at least one receiving groove, and a bonding material is received in the dispensing groove and in one or more of the at least one receiving groove. A method of manufacturing a connector assembly comprises the steps of: providing a housing; soldering a cable to the housing; enclosing a metal shell to cover the housing; molding an inner member on cable to comprise a dispensing groove and at least one receiving groove behind the dispensing groove; setting an outer boot along a front-to-back direction onto the metal shell; and depositing a bonding material in the dispensing groove and pushing the outer boot forwardly across the dispensing groove and the at least one receiving groove until covering the whole inner member.

9 Claims, 6 Drawing Sheets

(56) References Cited

U.S. PATENT DOCUMENTS 7,878,855 B2 * 2/2011 Li ..... H01R 13/65802 439/607.04
7,922,536 B2 * 4/2011 Zhang ..... H01R 13/6485 361/127
7,952,848 B2 * 5/2011 Whalin ..... H01R 13/6485 361/127
8,007,317 B2 * 8/2011 Su ..... H01R 13/502 439/607.46
8,070,525 B2 * 12/2011 Hou ..... H01R 13/506 439/660
8,262,411 B2 * 9/2012 Kondo ..... H01R 13/6658 439/607.01
8,303,342 B2 * 11/2012 Shi ..... H01R 24/60 439/607.41
8,333,616 B2 * 12/2012 Su ..... H01R 13/6581 439/607.41
8,366,490 B2 * 2/2013 Wu ..... H01R 13/502 439/660
8,403,706 B2 * 3/2013 Wu ..... H01R 13/506 439/607.46
8,430,693 B2 * 4/2013 Wu ..... H01R 13/6658 439/607.5
8,834,197 B2 * 9/2014 Wu ..... H01R 23/005 439/497
8,840,321 B2 * 9/2014 Wu ..... G02B 6/3817 385/89
9,048,584 B2 * 6/2015 Thackston ..... H01R 13/6581
9,059,531 B2 * 6/2015 Schmidt ..... H01R 13/6581
9,065,205 B2 * 6/2015 Gao ..... H01R 13/508
2007/0095862 A1 * 5/2007 Swiss ..... B65D 47/205 222/494
2012/0071022 A1 3/2012 Su et al.
2014/0073185 A1 3/2014 Siahaan et al.

* cited by examiner

CONNECTOR ASSEMBLY WITH FIRM STRUCTURE AND METHOD OF ASSEMBLING THE SAME

BACKGROUND OF THE INVENTION

1. Field of the Invention

The present invention relates to a connector assembly, and more particularly to a structure of an outer boot thereof and a method of mounting the outer boot.

2. Description of Related Arts

U.S. Patent Application Publication No. 20120071022, published on Mar. 22, 2012, discloses a cable assembly comprises a plurality of first conductive terminals, an insulative housing molding on the first conductive terminals, a mounting bar installed in the insulative housing, a plurality of second conductive terminals enclosed in the mounting bar, a PCB (printed circuit board) located behind the insulative housing, a cable soldered on the PCB, a metal shell enclosing the insulative housing, and a rear cover installed on the rear of the metal shell. The rear cover is fixed with the metal shell through interference fit. Therefore, the rear cover may not be firmly installed.

US 2014/0073185 A1, published on Mar. 13, 2014, discloses a cable assembly and a method of manufacturing such cable assembly. The cable assembly comprises an enclosure manufactured from plastic material. When mounting the enclosure, bonding material is deposited on two locations on an inside surface thereof. The bonding material may be deposited with a syringe and needle assembly.

An improved connector assembly is desired to offer advantages over the related art.

SUMMARY OF THE INVENTION

An object of the present invention is to provide a connector assembly with firm structure of the outer boot and improved appearance and an associated manufacturing method.

To achieve the above-mentioned object, a connector assembly comprises: a housing; a metal shell enclosing the housing; a plurality of conductive terminals held in the housing; a cable connected with the conductive terminals; an inner member molded on the cable; and an outer boot enclosing the metal shell, the cable, and the inner member; wherein the inner member further comprises a dispensing groove and at least one receiving groove behind the dispensing groove, and a bonding material is received in the dispensing groove and in one or more of the at least one receiving groove. A method of manufacturing a connector assembly comprises the steps of: providing a housing; soldering a cable to the housing; enclosing a metal shell to cover the housing; molding an inner member on the cable to comprise a dispensing groove and at least one receiving groove behind the dispensing groove; setting an outer boot along a front-to-back direction onto the metal shell; and depositing a bonding material in the dispensing groove and pushing the outer boot forwardly across the dispensing groove and the at least one receiving groove until covering the whole inner member.

According to the present invention, the bonding material disposed in the dispensing groove makes the outer boot fixed firmly, and excessive bonding material received in the receiving groove guarantees the appearance of the cable assembly.

DETAILED DESCRIPTION OF THE PREFERRED EMBODIMENT

Figure 1:
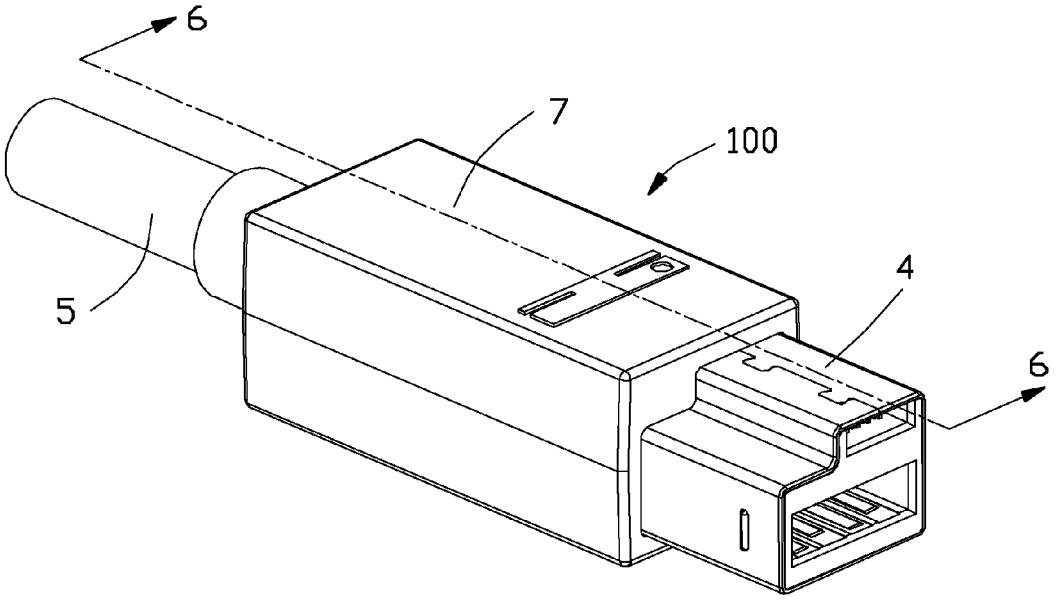
FIG. 1 is a perspective view of a connector assembly in accordance with the present invention.
Figure 2:
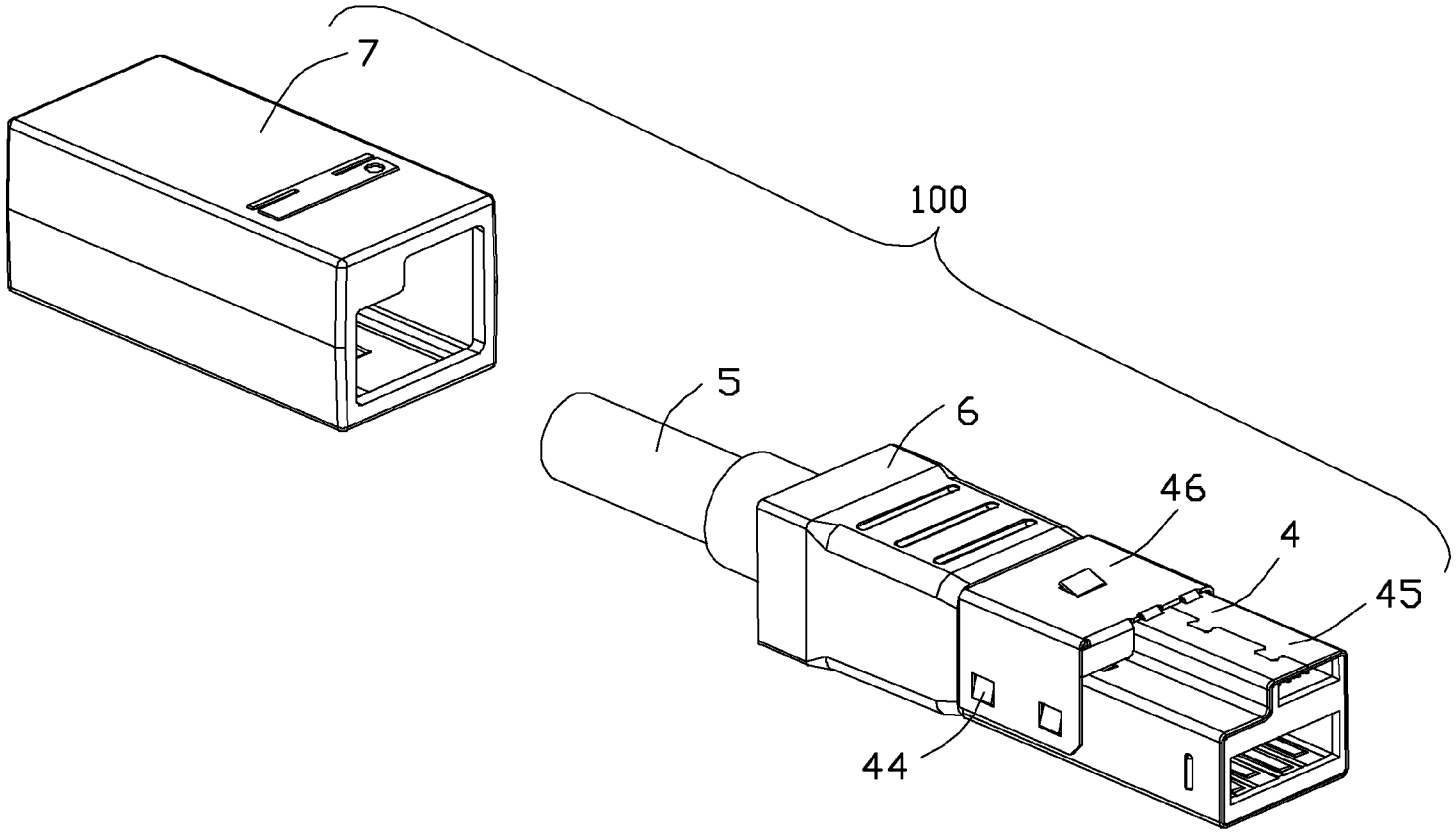
FIG. 2 is a partly exploded view of the connector assembly as shown in FIG. 1.
Figure 3:
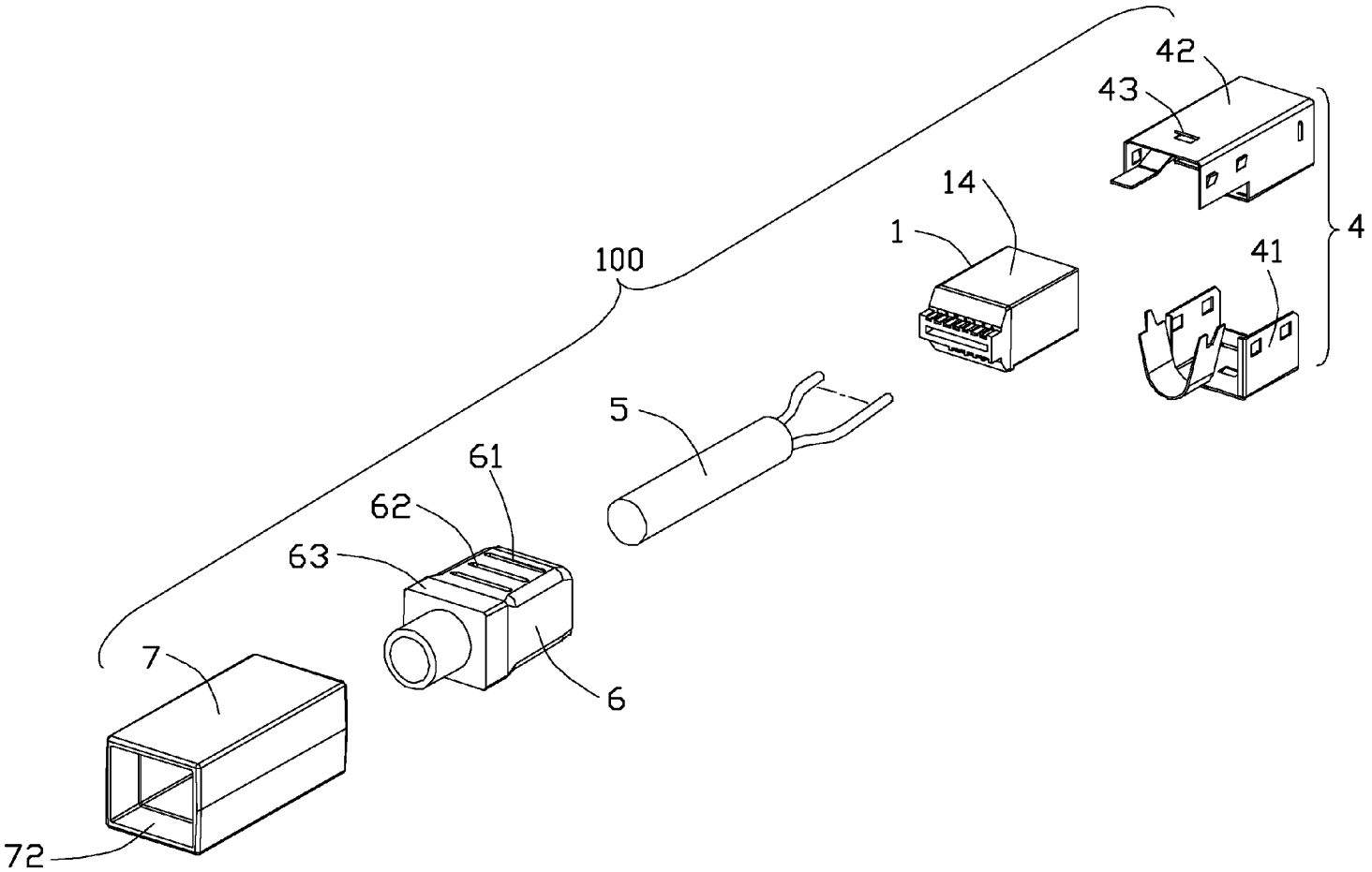
FIG. 3 is another partly exploded view of the connector assembly as shown in FIG. 1.
Figure 4:
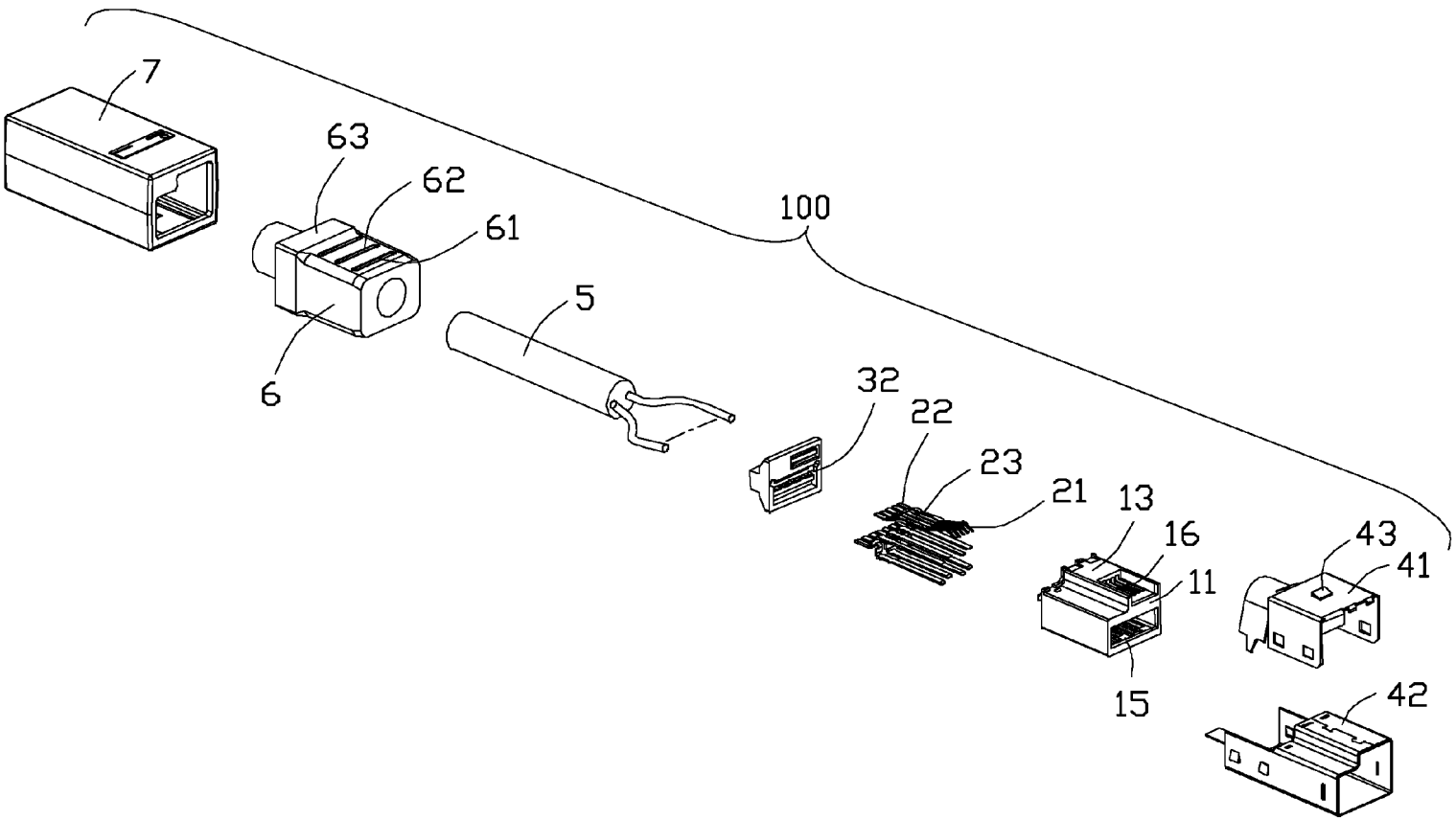
FIG. 4 is an exploded view of the connector assembly as shown in FIG. 1.
Figure 5:
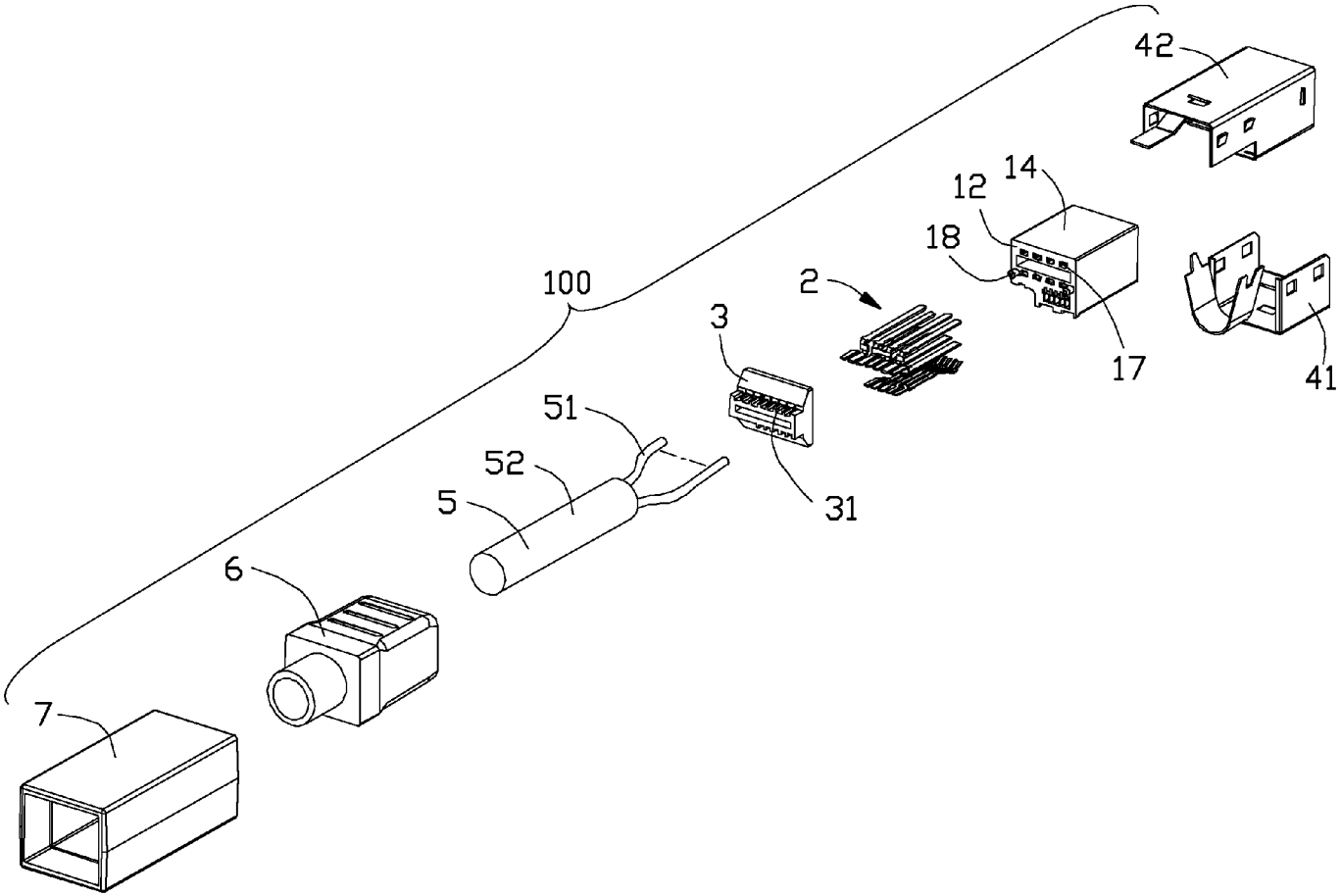
FIG. 5 is another exploded view of the connector assembly as shown in FIG. 1.

Reference will now be made in detail to a preferred embodiment of the present invention.

Referring to FIGS. 1 to 5, a connector assembly 1 includes a housing 1, a plurality of conductive terminals 2 held in the housing 2, a spacer 3 holding the conductive terminals 2, a metal shell 4 enclosing the housing 1, a cable 5 electrically connected with the conductive terminals 2, an inner member 6 molded on the cable 5, and an outer boot 7 set along a front-to-back direction to cover part of the metal shell 4 and the cable 5.

The housing 1 includes a front face 11, a corresponding rear face 12, an upper face 13, and a corresponding lower face 14. The housing 1 comprises a first receiving portion 15 and a second receiving portion 16 for receiving the conductive terminals 2. The first receiving portion 15 goes through the front face 11 and the rear face 12 of the housing 1 and forming a plurality of terminal holes 17 on the rear face 12. The second receiving portion 16 is disposed on the upper face 13 and goes through the rear face 12 and also forming a plurality of terminal holes 17 on the rear face 12. The rear face 12 of the housing 1 projects outwardly to form a pair of mounting posts 18.

Each conductive terminal 2 comprises a mating portion 21 received in the housing 1 for mating with a mating connector (not shown), a soldering portion 22 held on the spacer 3 for soldering with the cable 5, and a connecting portion 23 connecting the mating portion 21 and the soldering portion 22.

The spacer 3 comprises a plurality of holding slots 31 limiting the conductive terminals 2. A front end of the spacer 3 comprises a pair of mounting holes 32 for mating with the mounting posts 18 of the housing 1.

Figure 6:
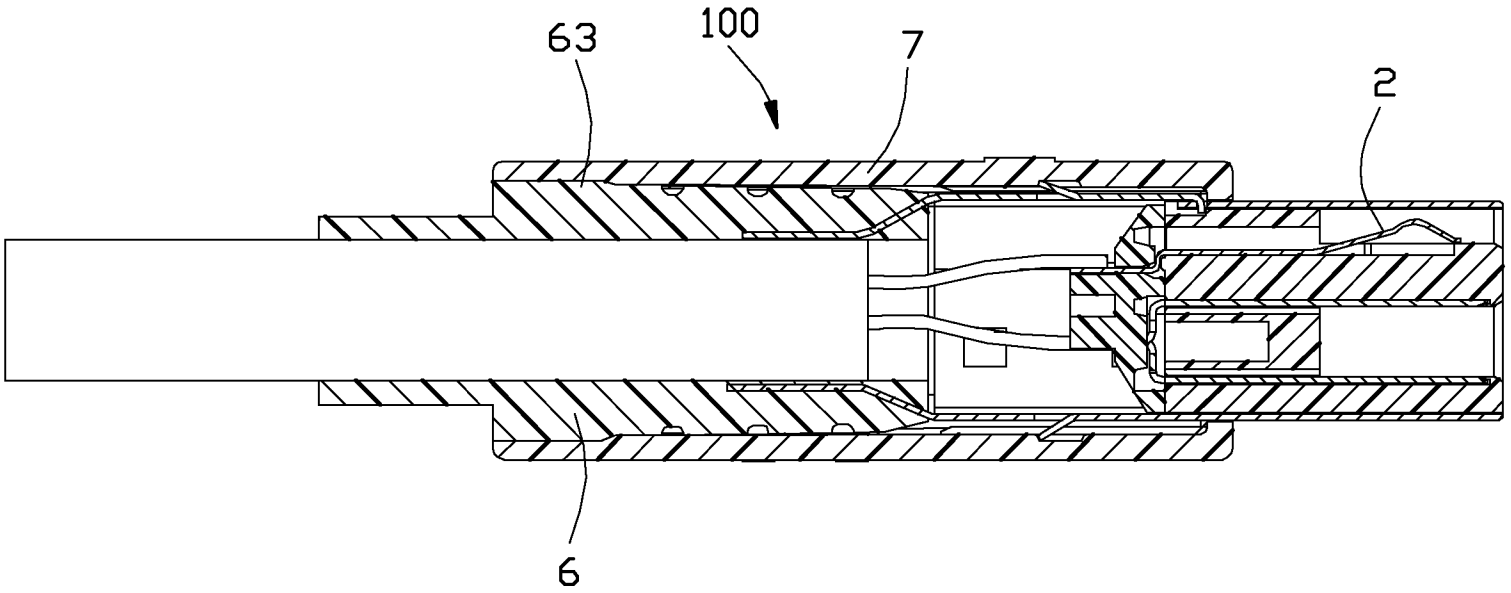
FIG. 6 is a cross-sectional view of the connector assembly taken along line 6-6 of FIG. 1.

The metal shell 4 comprises an upper shell 41 and a lower shell 42 mating with the upper shell 41. Referring to FIG. 6, the metal shell 4 comprises a spring tab 43 for interference mating with the outer boot 7 to prevent the outer boot 7 from receding after mounting the outer boot 7. Each the upper shell 41 and the lower shell 42 comprises the spring tab 43. The upper shell 41 and the lower shell 42 include a latching portion 44 for latching each other. A first portion 45 and a second portion 46 are formed after the upper shell 41 and the lower shell 42 fixed together. The first portion 45 is received in the outer boot 7, and the second portion 46 is exposed out of the outer boot 7. The metal shell 4 comprises a copper layer disposed on the second portion 46 to reduce electromagnetic interference (EMI).

The cable 5 comprises a plurality of core wires 51 and an insulative layer 52 enclosing the core wires 51.

The inner member 6 enclosed by the outer boot 7 comprises a dispensing groove 61 for receiving bonding material, such as glues, and at least one receiving groove 62 in a same plane and behind the dispensing groove 61. The receiving groove 62 is used for preventing the glue in the dispensing groove 61 from flowing out of the outer boot 7 when mounting the outer boot 7. It guarantees the connector assembly 100 clear and having a good appearance. The inner member 6 comprises a step portion 63 projecting outwardly on a rear end thereof. The outer boot 7 encloses the step portion 63 to further prevent the glue from flowing out of the outer boot 7. Each the upper surface and the lower surface can be disposed the dispensing groove 61 and the receiving groove 62.

The outer boot 7 is a rectangular frame and fixed with the inner member 6 through the glue in the dispensing groove 61. The outer boot 7 comprises a corresponding recessing slot 71 interference mating with the spring tab 43 to prevent the outer boot 7 receding before the glue solidification. The outer boot 7 comprises a mating portion 72 to enclose the step portion 63. A thickness of the mating portion 72 is thinner than the thickness of other part of the outer boot 7.

A method of assembling the connector assembly 100 comprises the steps of: providing the housing 1 firstly; mounting a plurality of conductive terminals 2 into the terminals holes 17 of the housing 1; mounting the spacer 3 to the housing 1 by way of inserting the mounting posts 18 into the mounting holes 32; extending the soldering portions 22 of the conductive terminals 2 out of the spacer 3 and disposing the soldering portions 22 in the holding slots 31 of the spacer 3; connecting the cable 5 to the housing 1, specifically soldering the core wires 51 of the cable 5 to the soldering portion 22 of each conductive terminal 2 limited in the holding slot 31, respectively; providing the metal shell 4 to enclose the housing 1; fixing a rear end of the metal shell 4 with the cable 5; disposing the copper layer to enclose the second portion 46 of the metal shell 4 to cover the slits between the upper shell 41 and the lower shell 42 and the slits of the connection portion of the cable 5 to reduce the EMI; molding the inner member 6 on the cable 5; setting the outer boot 7 along a front-to-back direction to the metal shell 4 and the inner member 6; depositing glue in the dispensing groove 61, and then pushing the outer boot 7 across the dispensing groove 61 and until covering the whole inner member 6. The outer boot 7 is fixed with the inner member 6 through the glue. To provide further maintaining force, the spring tab 43 of the metal shell 4 mate with the recessing slot 71 to make the outer boot 7 stable. Excessive glue will be received in the receiving groove 61 to prevent the glue from flowing out of the outer boot 7. The step portion 63 further prevents the glue from flowing out of the outer boot 7. In this embodiment, there are two receiving grooves 62; in other embodiments, it can be one or more.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly comprising:

a housing;

a metal shell enclosing the housing;

a plurality of conductive terminals held in the housing;

a cable connected with the conductive terminals;

an inner member molded on the cable; and an outer boot enclosing the metal shell, the cable, and the inner member; wherein the inner member further comprises a dispensing groove and at least one receiving groove behind the dispensing groove, and a bonding material is received in the dispensing groove and in one or more of the at least one receiving groove.

2. The connector assembly as recited in claim 1, wherein the inner member comprises a step portion projecting outwardly on a rear end thereof, the outer boot enclosing the step portion to prevent the bonding material from flowing out of the outer boot.

3. The connector assembly as recited in claim 2, wherein the outer boot comprises a mating portion to enclose the step portion, a thickness of the mating portion being thinner than the thickness of other part of the outer boot.

4. The connector assembly as recited in claim 3, wherein the metal shell comprises a spring tab, and the outer boot comprises a corresponding recessing slot interference mating with the spring tab to prevent the outer boot from receding before the bonding material solidifies.

5. The connector assembly as recited in claim 1, wherein the metal shell comprises a copper layer received in the outer boot to reduce electromagnetic interference.

6. A method of manufacturing a connector assembly, comprising the steps of:

providing a housing;

soldering a cable to the housing;

enclosing a metal shell to cover the housing;

molding an inner member on the cable to comprise a dispensing groove and at least one receiving groove behind the dispensing groove;

setting an outer boot along a front-to-back direction onto the metal shell; and depositing a bonding material in the dispensing groove and pushing the outer boot forwardly across the dispensing groove and the at least one receiving groove until covering the whole inner member.

7. The method as recited in claim 6, wherein the step of molding the inner member comprises forming a stepped portion on a rear end of the inner member to prevent the bonding material from flowing out of the outer boot.

8. The method as recited in claim 6, further comprising disposing a spring tab on the metal shell to prevent the outer boot from receding after mounting the outer boot.

9. The method as recited in claim 6, further comprising disposing a copper layer on a part of the metal shell in the outer boot to reduce electromagnetic interference.

* * * * *